United States Patent [19]

Schneider et al.

[11] Patent Number: 4,924,202

[45] Date of Patent: May 8, 1990

[54] NON-CYCLING ELECTRICAL CIRCUIT BREAKER

[75] Inventors: John L. Schneider, Raymond; Stephen T. Manchester, Limerick, both of Me.

[73] Assignee: GTE Products Corporation, Stamford, Conn.

[21] Appl. No.: 315,648

[22] Filed: Feb. 27, 1989

[51] Int. Cl.[5] ..... H01H 71/22
[52] U.S. Cl. ..... 337/100; 337/102
[58] Field of Search ..... 337/99–108

[56] References Cited

FOREIGN PATENT DOCUMENTS 1495779 9/1967 France ..... 337/100
707316 5/1954 United Kingdom ..... 337/102

*Primary Examiner*—H. Broome
*Attorney, Agent, or Firm*—James Theodosopoulos

[57] ABSTRACT

A circuit breaker comprises a compensator bimetal and a main bimetal which deflect in the same direction when heated. Each bimetal carries an electrical contact, which are normally in contact with each other. Upon overload, the contacts open. However, opening of the contacts causes electric current to flow through a heater wire wrapped around the armature bimetal, thereby keeping the main bimetal deflected and keeping the contacts apart.

4 Claims, 1 Drawing Sheet

NON-CYCLING ELECTRICAL CIRCUIT BREAKER

This invention concerns circuit breakers containing two bimetals, one of which is a compensator. Examples of such circuit breakers are shown in U.S. Pat. Nos. 2,585,068, 4,521,760, 4,636,766 and 4,663,606. In these examples, the circuit breakers are of the cycling type, which means that when the contacts open to interrupt the flow of electric current, the bimetals cool down and the contacts re-close.

This invention concerns a non-cycling circuit breaker, which means that when the contacts open, current flow is maintained through a heater to keep the contacts open until a remote switch is turned off to disconnect current flow.

In this invention, the compensator bimetal and the armature bimetal are both elongated; the armature bimetal is longer than the compensator bimetal; they both deflect in the same direction when heated; and a heater wire wrapped around the armature bimetal keeps the armature bimetal hot upon opening of the contacts and prevents closure of the contacts as long as current flow is maintained through the heater wire. Circuit breakers as per this invention can be used at high ambient temperatures, say, about 125° C.

Figure 1:
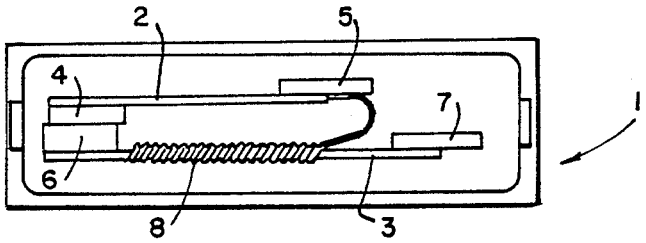
Figure 2:
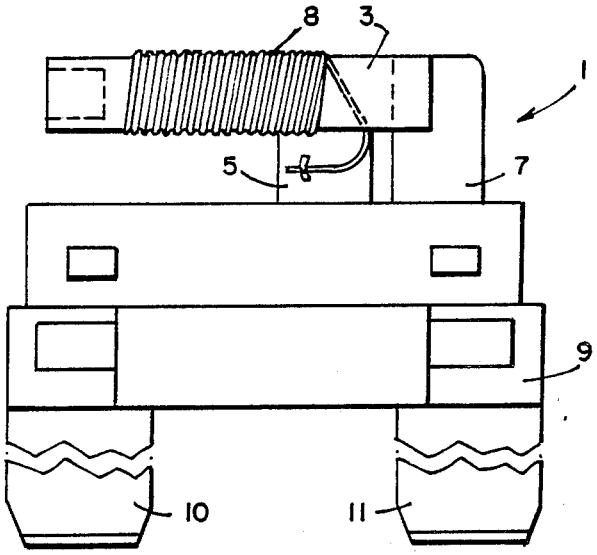
Figure 3:
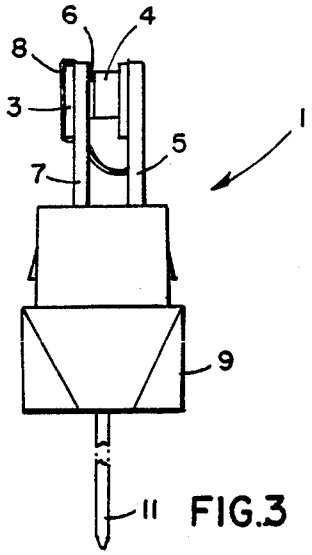

In the drawing, FIG. 1 is a plan view and FIGS. 2 and 3 are front and side elevational views of one example of a circuit breaker in accordance with this invention.

As shown in the drawing, circuit breaker 1 contains a compensator 2 and an armature bimetal 3 which are substantially parallel to each other. There is a contact 4 (contact A) at one end of compensator 2, the other end of compensator 2 being fastened to terminal 5 (terminal A). There is a contact 6 (contact B) at one end of armature bimetal 3, the other end of armature bimetal 3 being fastened to terminal 7 (terminal B). A heater wire 8 is wrapped around armature bimetal 3 and is electrically connected between terminals 5 and 7. Thus, heater wire 8 is in parallel with contacts 4 and 6 which, during normal operation, are in contact with each other.

In operation, compensator 2 and armature bimetal 3 deflect in the same direction upon being heated. For example, in FIG. 1, the upper surfaces of both compensator 2 and armature bimetal 3 are high expansion layers, and the lower surfaces are low expansion layers. Thus, upon being heated, both compensator 2 and armature bimetal 3 deflect downwards. Upon attainment of a predetermined opening current or temperature, armature bimetal 3 deflects sufficiently to overcome both the initial contact pressure between contacts 4 and 6, and the deflection of compensator 2, thereby separating contacts 4 and 6 and stopping the current flow through contacts 4 and 6. However, current then starts flowing through heater wire 4, which heats armature bimetal 3 and keeps it deflected, thereby keeping contacts 4 and 6 apart. Compensator 2, meanwhile, cools down and retracts to its original position. As long as current flows through heater wire 4, contacts 4 and 6 remain apart. When current flow to heater wire 4 is terminated, such as by opening a remote switch, main bimetal 3 cools down and retracts to its original position, thereby placing contacts 4 and 6 in electrical contact with each other.

In one example, compensator 2 was 608 mils long, 156 mils wide, 20 mils thick. Armature bimetal 3 was 850 mils long, 156 mils wide, 20 mils thick. Heater wire 8 consisted of 22 turns of insulated 4 mils diameter 60 Ni, 16 Cr, 24 Fe resistance wire wrapped around main bimetal 3 and adhesively secured thereto. One end of heater wire 8 was welded to armature bimetal 3; the other end of heater wire 8 was welded to terminal 5. In operation, with contacts 4 and 6 closed, no current flowed through heater wire 8 (because of its higher resistance path). Upon overload, with contacts 4 and 6 open, current flowed through heater wire 8. The resistance of heater wire 8 was about 30 ohms. At a 12 volt power source, current flow through heater wire 8 was about 0.4 amperes, equivalent to about 4.8 watts of power across heater wire 8. This generated enough heat on armature bimetal 3 to keep armature bimetal 3 deflected and, thereby, keeping contacts 4 and 6 open.

Terminals 5 and 7 are secured in and extend through, plastic base 9 and have respective plug-in bottom portions 10 and 11 which can be inserted into a suitable electrical receptacle.

We claim:

1. An electrical circuit breaker comprising: an elongated compensator bimetal having a contact A at one end thereof and connected to a terminal A at its other end; an elongated armature bimetal having a contact B at one end thereof and connected to a terminal B at its other end; the arrangement of the high and low expansion layers of the bimetals being such that the bimetals deflect in the same direction when they are heated; a heater wire wrapped around the armature bimetal and electrically connected between terminals A and B, the arrangement of the heater wire being such that, in operation, with contacts A and B closed, no current flows through the heater wire but upon overload, when contacts A and B open, current flows through the heater wire and generates sufficient heat to keep the armature bimetal deflected, thereby keeping contacts A and B apart.

2. The circuit breaker of claim 1 wherein one end of the heater wire is fastened to the armature bimetal and the other end of the heater wire is fastened to terminal A.

3. The circuit breaker of claim 1 wherein the armature bimetal is longer than the compensator bimetal.

4. The circuit breaker of claim 3 wherein the armature bimetal and the compensator bimetal are substantially parallel to each other.

* * * * *